US012085072B2

(12) United States Patent
Magyar et al.

(10) Patent No.: US 12,085,072 B2
(45) Date of Patent: Sep. 10, 2024

(54) SYSTEMS AND METHODS FOR A PUMP HAVING AN ONBOARD USER INTERFACE

(71) Applicant: Regal Beloit America, Inc., Beloit, WI (US)

(72) Inventors: Justin Magyar, Beloit, WI (US); James Reed, Beloit, WI (US); Nathan Snell, Beloit, WI (US); Tony Zhang, Beloit, WI (US); Howard Richardson, Beloit, WI (US); Henry Huynh, Beloit, WI (US); Stephen T. English, Beloit, WI (US); Wenbing Li, Beloit, WI (US); Hongbo Tang, Beloit, WI (US)

(73) Assignee: Regal Beloit America, Inc., Milwaukee, WI (US)

( * ) Notice: Subject to any disclaimer, the term of this patent is extended or adjusted under 35 U.S.C. 154(b) by 552 days.

(21) Appl. No.: 17/359,029

(22) Filed: Jun. 25, 2021

(65) Prior Publication Data

US 2022/0034311 A1 Feb. 3, 2022

Related U.S. Application Data

(60) Provisional application No. 63/058,353, filed on Jul. 29, 2020.

(51) Int. Cl.

| | |
|---|---|
| ***H02K 7/14*** | (2006.01) |
| ***F04B 17/03*** | (2006.01) |
| ***F04B 49/20*** | (2006.01) |
| *E04H 4/12* | (2006.01) |

(52) U.S. Cl.

CPC ..... *F04B 49/20* (2013.01); *F04B 17/03* (2013.01); *E04H 4/1245* (2013.01); *F04B 2207/702* (2013.01)

(58) Field of Classification Search

CPC . H02P 27/06; H02P 6/08; H02P 23/16; E04H 4/1245

See application file for complete search history.

(56) References Cited

U.S. PATENT DOCUMENTS

| | | | | |
|---|---|---|---|---|
| 1,411,145 | A | 3/1922 | Whitted | |
| 5,120,198 | A | 6/1992 | Clark | |
| 10,294,686 | B1 * | 5/2019 | Erlich | E04H 4/1654 |

(Continued)

FOREIGN PATENT DOCUMENTS

| | | | |
|---|---|---|---|
| CA | 1065964 | A | 11/1979 |
| CN | 202956656 | U | 5/2013 |

(Continued)

*Primary Examiner* — Karen Masih

(74) *Attorney, Agent, or Firm* — Armstrong Teasdale LLP

(57) ABSTRACT

A motor controller for a pump motor is provided. The motor controller includes an input device and a memory configured to store a plurality of actuation sequences and a plurality of commands. Each actuation sequence is associated with a command. The motor controller further includes a processor coupled to the input device, the memory, and the pump motor. The processor is configured to detect at the input device, a first actuation sequence in response to the input device being actuated. The processor is further configured to perform a lookup in the memory to determine a first command corresponding to the first actuation sequence. The processor is further configured to operate the pump motor according to the first command.

20 Claims, 14 Drawing Sheets

(56) References Cited

U.S. PATENT DOCUMENTS

| | | | | |
|---|---|---|---|---|
| 10,931,472 | B2 | 2/2021 | Khalid et al. | |
| 10,976,713 | B2 * | 4/2021 | Potucek | G05B 19/0421 |
| 11,000,449 | B2 | 5/2021 | Potucek et al. | |
| 2014/0277775 | A1 * | 9/2014 | McKinzie | F04B 49/20 700/282 |
| 2019/0314243 | A1 | 10/2019 | MacCallum et al. | |
| 2020/0077497 | A1 | 3/2020 | Diep | |

FOREIGN PATENT DOCUMENTS

| | | | | |
|---|---|---|---|---|
| CN | 105782072 | A | 7/2016 | |
| CN | 205823599 | U | 12/2016 | |
| CN | 111668942 | A | 9/2020 | |
| EP | 913582 | B1 | 9/2003 | |
| EP | 2778417 | A2 * | 9/2014 | F04B 49/065 |
| JP | S62058097 | A | 3/1987 | |
| JP | 2001041189 | A | 2/2001 | |
| JP | 2001059490 | A | 3/2001 | |
| JP | 2001059491 | A | 3/2001 | |
| JP | 2001082377 | A | 3/2001 | |
| JP | 2001082378 | A | 3/2001 | |
| JP | 2001115987 | A | 4/2001 | |
| JP | 2001123984 | A | 5/2001 | |
| JP | 2001173586 | A | 6/2001 | |
| JP | 03814635 | B2 | 8/2006 | |
| KR | 101256479 | B1 | 4/2013 | |
| KR | 101671957 | B1 | 11/2016 | |
| KR | 20190069517 | A * | 6/2019 | |
| PL | 144958 | B1 | 7/1988 | |

* cited by examiner

900

| 902 Button Sequence | 904 Executed Command | 906 Prime when Started from a Stopped Position | Description | | | | | | | |
|---|---|---|---|---|---|---|---|---|---|---|
| | | | 910 Speed (RPM) | 912 Duration (HR) | 910 Speed (RPM) | 912 Duration (HR) | 910 Speed (RPM) | 912 Duration (HR) | 910 Speed (RPM) | 912 Duration (HR) |
| •— | Schedule #1 | None | 3450 | 2 | 1725 | 8 | 1100 | 2 | OFF | 12 |
| ••— | Schedule #2 | None | 3450 | 4 | 1725 | 4 | 1100 | 4 | OFF | 12 |
| •••— | Schedule #3 | 3 Min. @ 3450 | 3100 | 2 | 1725 | 8 | 3100 | 2 | OFF | 12 |
| ••••— | Schedule #4 | 3 Min. @ 3450 | 2850 | 6 | 1725 | 6 | OFF | 12 | OFF | 0 |
| •••••— | Schedule #5 | 3 Min. @ 3450 | 1725 | 24 | OFF | 0 | OFF | 0 | OFF | 0 |
| ••••••— | Schedule #6 | None/Water Feature | 1100 | 24 | OFF | 0 | OFF | 0 | OFF | 0 |
| •••••••— | Schedule #7 | None/Water Feature | 1725 | 24 | OFF | 0 | OFF | 0 | OFF | 0 |
| ••••••••— | Schedule #8 | None/Water Feature | 3450 | 24 | OFF | 0 | OFF | 0 | OFF | 0 |
| • | Temporary Override | None | 3450 | 24 | OFF | 0 | OFF | 0 | OFF | 0 |
| — | Motor Pause Stop/Start | 3 Min. @ 3450 | | | | | | | | |

FIG. 9

SYSTEMS AND METHODS FOR A PUMP HAVING AN ONBOARD USER INTERFACE

CROSS-REFERENCE TO RELATED APPLICATION

This application claims priority to U.S. Provisional Application Ser. No. 63/058,353, filed Jul. 29, 2020, entitled "SYSTEMS AND METHODS FOR A PUMP HAVING AN ONBOARD USER INTERFACE," which is incorporated herein by reference in its entirety.

BACKGROUND

The field of the disclosure relates generally to a fluid moving system and, more specifically, a pool or spa pump system having an onboard user interface.

Pool and spa pumps are used to circulate water within the pool. The circulation of the water disperses chemicals added to the water to provide for acceptable water conditions. The circulation also permits the passage of water through a filter to remove impurities from the water. Typically the pump operates for a portion of the week, typically on a schedule. The pump is typically powered by an electric motor. The motor may be manually operated, wherein the operator manually controls the pump by manually turning the pump motor off and on.

Some pool pump systems have electronic controllers located in or adjacent the pool pump motors or within a pool system. These electronic controllers regulate the operation of the pool pump. These electronic controllers determine the on and off times of the pool pump motor. They may also control the speed of the pump if the pool pump motor has more than one possible speed.

BRIEF DESCRIPTION

In one aspect, a motor controller for a pump motor is provided. The motor controller includes an input device and a memory configured to store a plurality of actuation sequences and a plurality of commands. Each actuation sequence is associated with a command. The motor controller further includes a processor coupled to the input device, the memory, and the pump motor. The processor is configured to detect at the input device, a first actuation sequence in response to the input device being actuated. The processor is further configured to perform a lookup in the memory to determine a first command corresponding to the first actuation sequence. The processor is further configured to operate the pump motor according to the first command.

In another aspect, a method for controlling a pump motor is provided. The method includes detecting, by a motor controller at an input device, a first actuation sequence in response to the input device being actuated. The method further includes performing, by the motor controller, a lookup in a memory to determine a first command corresponding to the first actuation sequence. The memory is configured to store a plurality of actuation sequences and a plurality of commands. Each actuation sequence is associated with a command. The method further includes operating, by the motor controller, the pump motor according to the first command.

In another aspect, a pump motor is provided. The pump motor includes an inverter configured to supply current to stator coils. The pump motor further includes a motor controller. The motor controller includes an input device and a memory configured to store a plurality of actuation sequences and a plurality of commands. Each actuation sequence is associated with a command. The motor controller further includes a processor coupled to the input device, the memory, and the inverter. The processor is configured to detect at the input device, a first actuation sequence in response to the input device being actuated. The processor is further configured to perform a lookup in the memory to determine a first command corresponding to the first actuation sequence. The processor is further configured to operate the inverter according to the first command.

BRIEF DESCRIPTION OF THE DRAWINGS

FIG. 9 is a table illustrating exemplary modes of operation of the exemplary motor depicted in FIG. 2;

DETAILED DESCRIPTION

Embodiments of the pump system described herein include a motor controller including a processor in communication with a switch (e.g., a push button) to provide an onboard user interface. The processor is configured to detect sequences of actuations (sometimes referred to herein as "actuation sequences") input by a user at the switch and determine a command based on the actuation sequence. The command may correspond, for example, to a command to operate the pump motor at a certain speed, operate the pump motor according to a certain schedule, pause operation of the pump motor, or stop operation of the pump motor.

Additionally, embodiments of the pump system described herein provide further benefits such as, for example: (a) increasing cooling efficiency of a pump motor by providing open drip proof vents on a housing of the motor; (b) providing a shaft lock for a pump motor having a rear-mounted motor controller by providing a guide tube extending through a housing of the motor controller to provide access to the shaft lock; (c) enabling a motor to switch between two inputs corresponding to different voltage levels by including a single-connector wire with two different input configurations; (d) improving space efficiency of a pump motor by mounting a motor controller of the pump motor on a rear end of the pump motor; (e) increasing ease of use of a user interface of a pump motor by including a push button on the top 40 percent of a surface of a pump motor; (f) increasing cooling efficiency within a pump motor by providing two sets of vents disposed on opposite ends of a housing of the pump motor to increase air flow through the housing; (g) providing moisture protection to circuitry of a motor controller by providing a weep hole in a housing of the motor controller; and (h) increasing space efficiency of a pump motor by integrating a drive end bearing, heat sink, and end plate of a housing of the pump motor into a single piece.

Figure 1:
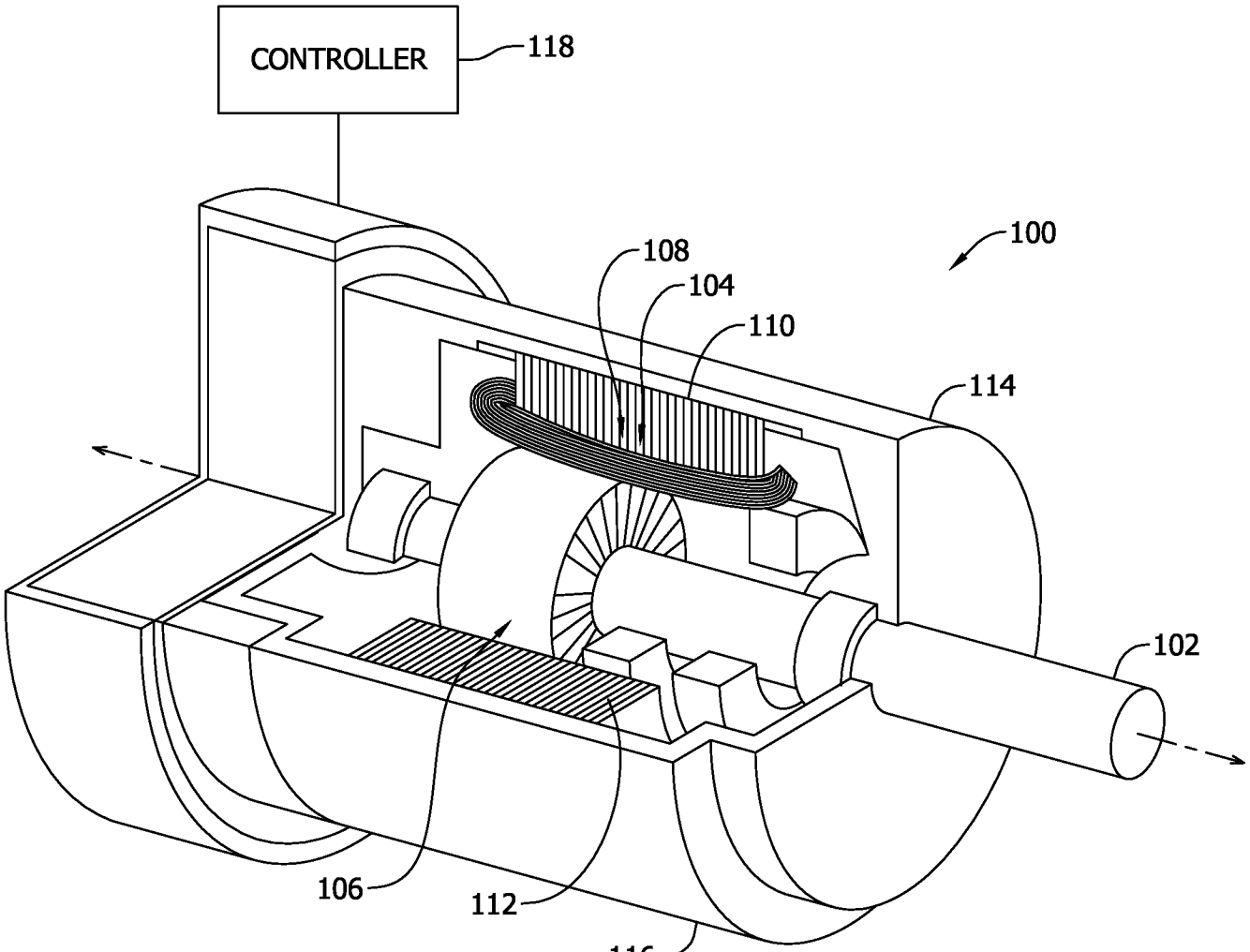
FIG. 1 is a partial cross-sectional view of an exemplary electric machine.

FIG. 1 is a partial cross-sectional view of an exemplary electric machine 100. The electric machine 100 may be an electric motor or an electric generator. It should be appreciated that the electric motor may be used to power any mechanism, for example, a pump, a cyclic drive, a compressor, a vehicle, a fan or a blower.

The electric machine 100 typically includes a centrally located motor shaft 102 that rotates relative to electric machine 100. Electrical energy, i.e., a voltage, is applied to coils 104 within electric machine 100. Coils 104 conduct an electric current to generate an electromagnetic field that cooperates with an electromagnetic field in rotor 106 mounted to the motor shaft 102. Coils 104 initiate relative motion between shaft 102 and electric machine 100 that transfers the power from coils 104 to shaft 102.

A stationary assembly 108, also referred to as a stator, includes stator core 110 and coils 104, or windings, positioned around portions of stator core 110. Energy is applied to coils 104 to initiate the relative motion that transfers the power to shaft 102. Coils 104 are formed by winding wire (not shown), typically copper, aluminum, or a combination thereof, about a central core to form the winding or coil. An electric current is directed through coils 104 that induces a magnetic field. The magnetic field induces the relative motion to transfer the power to shaft 102. The stator core 110 typically includes a solid core or a plurality of stator core laminations 112 that define stator teeth (not shown) around which coils 104 are wound.

Electric machine 100 generally includes a housing 114 having an inner wall or surface that defines a motor cavity therein. The housing 114 may include a plurality of components and may be made of a suitable durable material, for example a metal, a polymer, or a composite. The housing 114 may, as shown, include a cylindrical shell 116 and opposed end caps (not shown).

Housing 114 of the motor may have any suitable shape. One common shape of a motor housing is that of a cylindrical solid, having a generally cylindrical cross section. The shaft on a motor with such a shape generally extends from an end of the motor.

The electric machine 100 may have any suitable size and shape, and may be, for example, an induction motor, a permanent-split capacitor (PSC) motor, an electronically commutated motor (ECM) motor, or a switched reluctance motor. The electric machine 100 may, as shown, be a radial flux motor or may be an axial flux motor. The housing 114 may include protrusions, for example fins (not shown), for dissipation of heat. The electric machine 100 may also include a fan (not shown) positioned within housing 114. The electric machine 100 may be electronically controlled, particularly if the motor is an ECM motor, by, for example, a motor controller 118. The motor controller 118 may be internally or externally mounted to the electric machine 100. Alternatively, the motor controller 118 may be spaced from the electric machine 100 and may, for example, be a part of a system controller (not shown).

FIGS. 2-7 illustrate an exemplary motor 200. Motor 200 generally functions as described with respect to electric machine 100 shown in FIG. 1.

Figure 2:
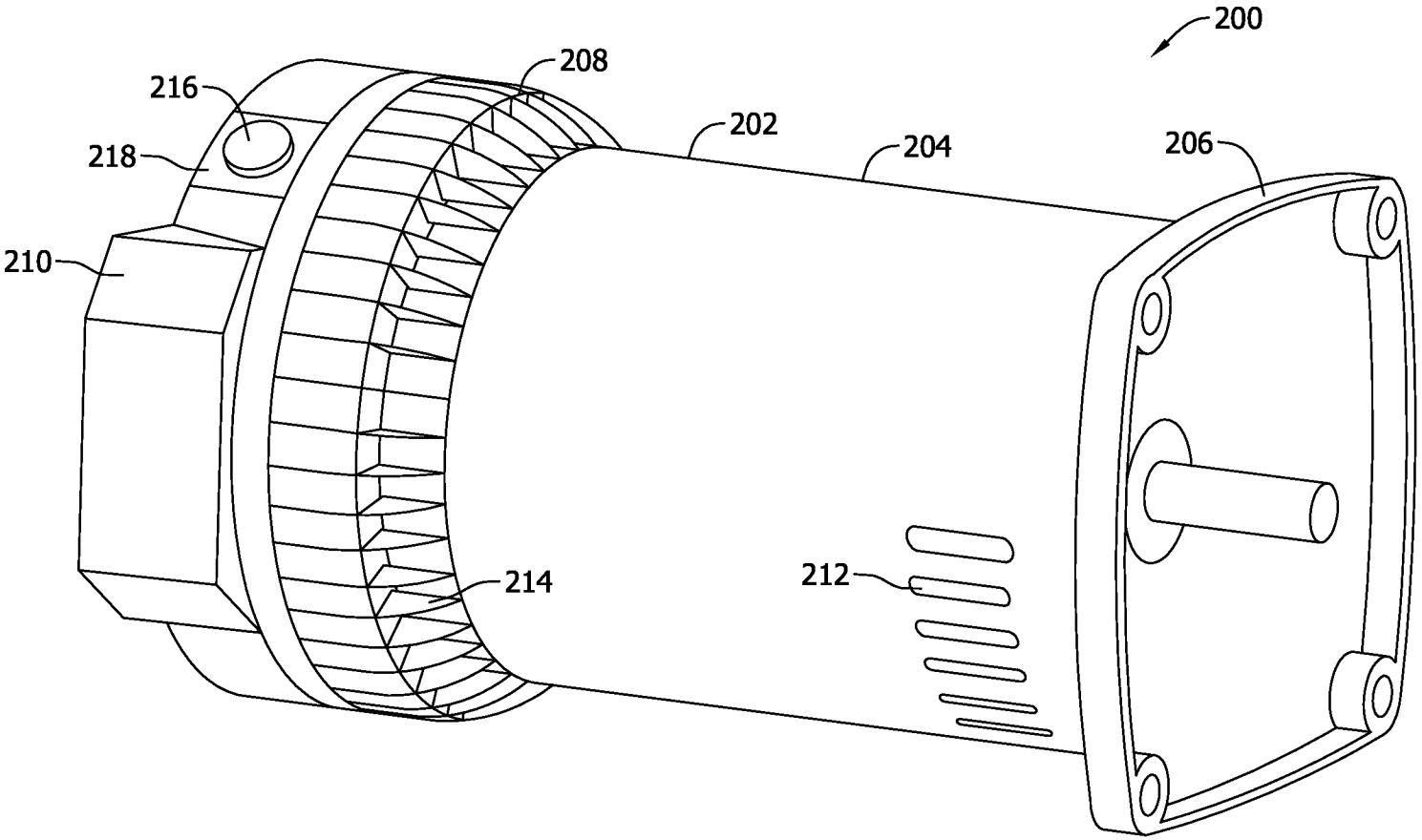
FIG. 2 is a perspective view of an exemplary motor that may be an implementation of the exemplary electric machine shown in FIG. 1.

Referring to FIG. 2, motor 200 includes a housing 202 having a main frame 204, a shaft end frame 206, a drive end frame 208, and a drive cover 210. Main frame 204, shaft end frame 206, and drive end frame 208 together form an enclosure that contains, for example, rotor 106 and stationary assembly 108. Drive end frame 208 and drive cover 210 form an enclosure that contains, for example, motor controller 118.

Main frame 204 includes open drip proof (ODP) holes 212. ODP holes 212 reduce the thermal load inside motor 200. ODP holes 212 enable increased reliability and lower cost of the electronics components of motor 200, such as those of motor controller 118, while preventing water ingress. Providing venting of motor 200 using ODP holes 212 further allows the use of materials for coils 104, such as aluminum, that generally bring about higher temperatures compared to other, more expensive materials, such as copper.

Drive end frame 208 includes air inlet holes 214. In some embodiments ODP holes 212 are located in duplicity with air inlet holes 214. For example, in some embodiments, a set of ODP vent holes 212 are located on the bottom 50% of the machine radius near the shaft end and a corresponding set of air inlet holes 214 are located on the bottom 50% of the machine radius near the opposite end. In such embodiments, an internal cooling fan may be located at the shaft end between rotor 106 and shaft end frame 206, such that the air flow enters at air inlet holes 214 and exits via ODP vent holes 212 to cool motor 200. In some embodiments, drive end frame 208 further functions as a heatsink for motor controller 118. This permits a cooling air flow generated by the fan at the shaft end to provide cooling by directing ambient air over the heatsink.

Motor 200 further includes a push button 216. Push button 216 is in communication with motor controller 118, and as described in further detail below, serves as a user interface of motor 200. In some embodiments, push button 216 is integrated with a light emitting diode LED 218 that is also in communication with motor controller 118 and may be used to provide user feedback. In some embodiments, push button 216 is located on the top 40% of an outside circumference of drive cover 210. In some such embodiments, push button 216 is not located in the top 10% to avoid both accidental engagement or glare from the sun interfering with LED 218. In some embodiments, push button 216 is located remote from any conduit entry so as to prevent the conduit from interfering with its use.

Figure 3:
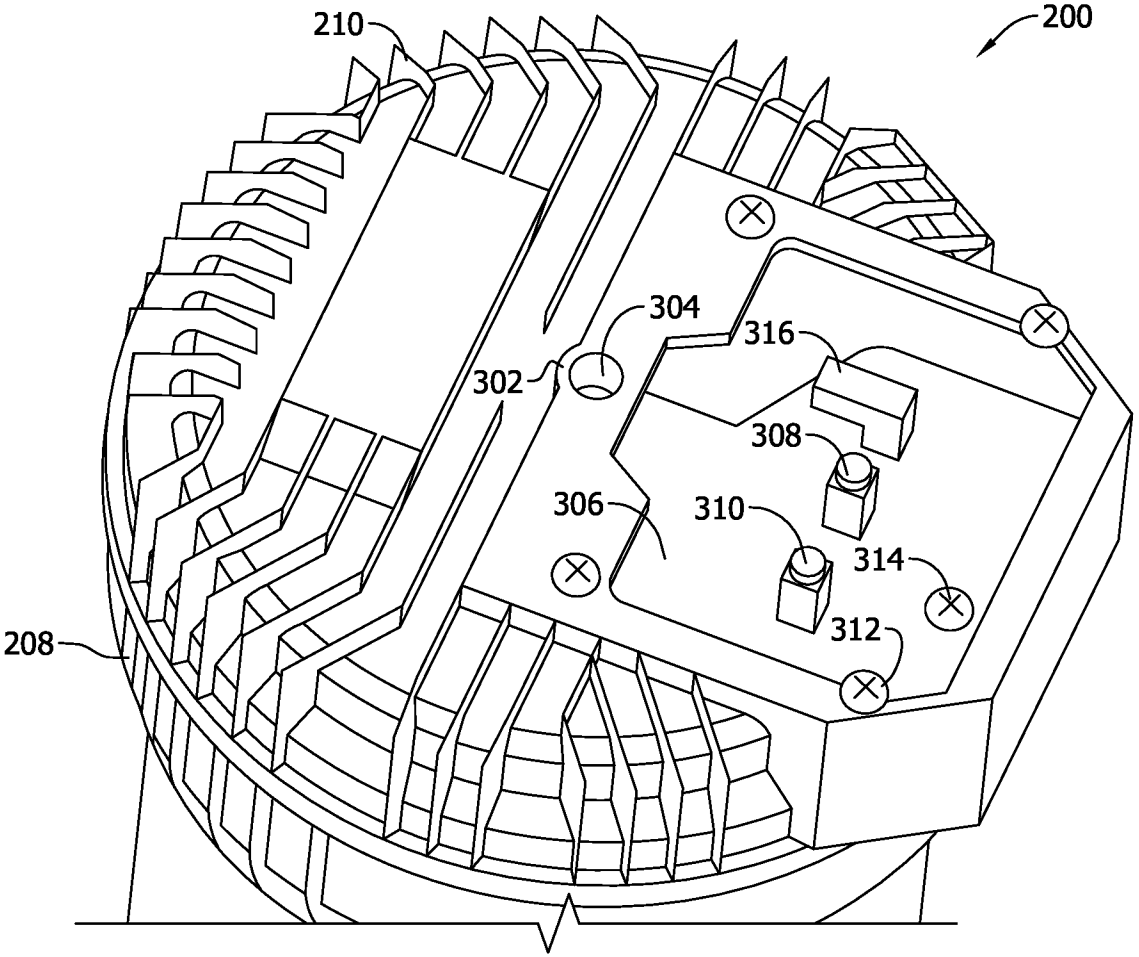
FIG. 3 is another perspective view of the exemplary motor depicted in FIG. 2.
Figure 4:
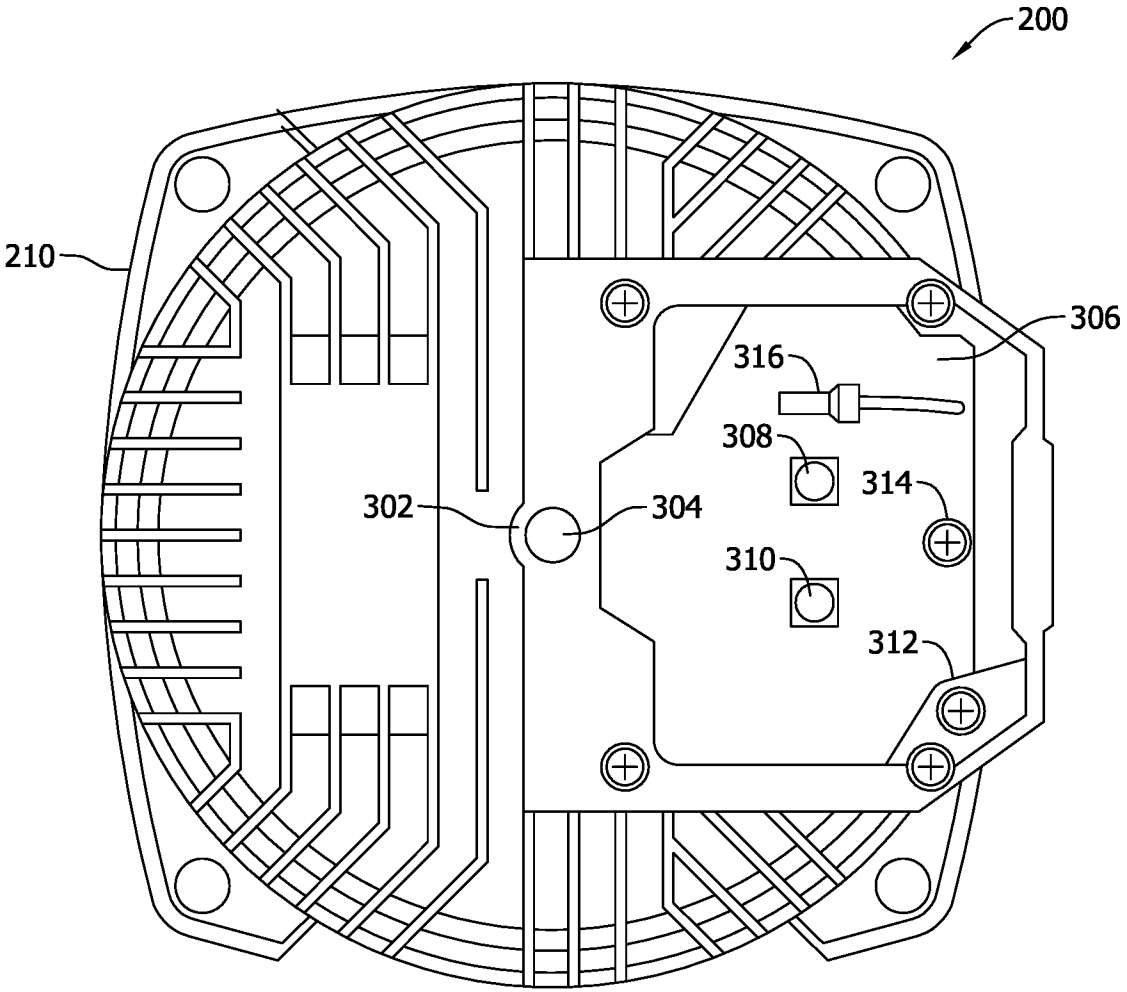
FIG. 4 is an end view of the exemplary motor depicted in FIG. 2.
Figure 5:
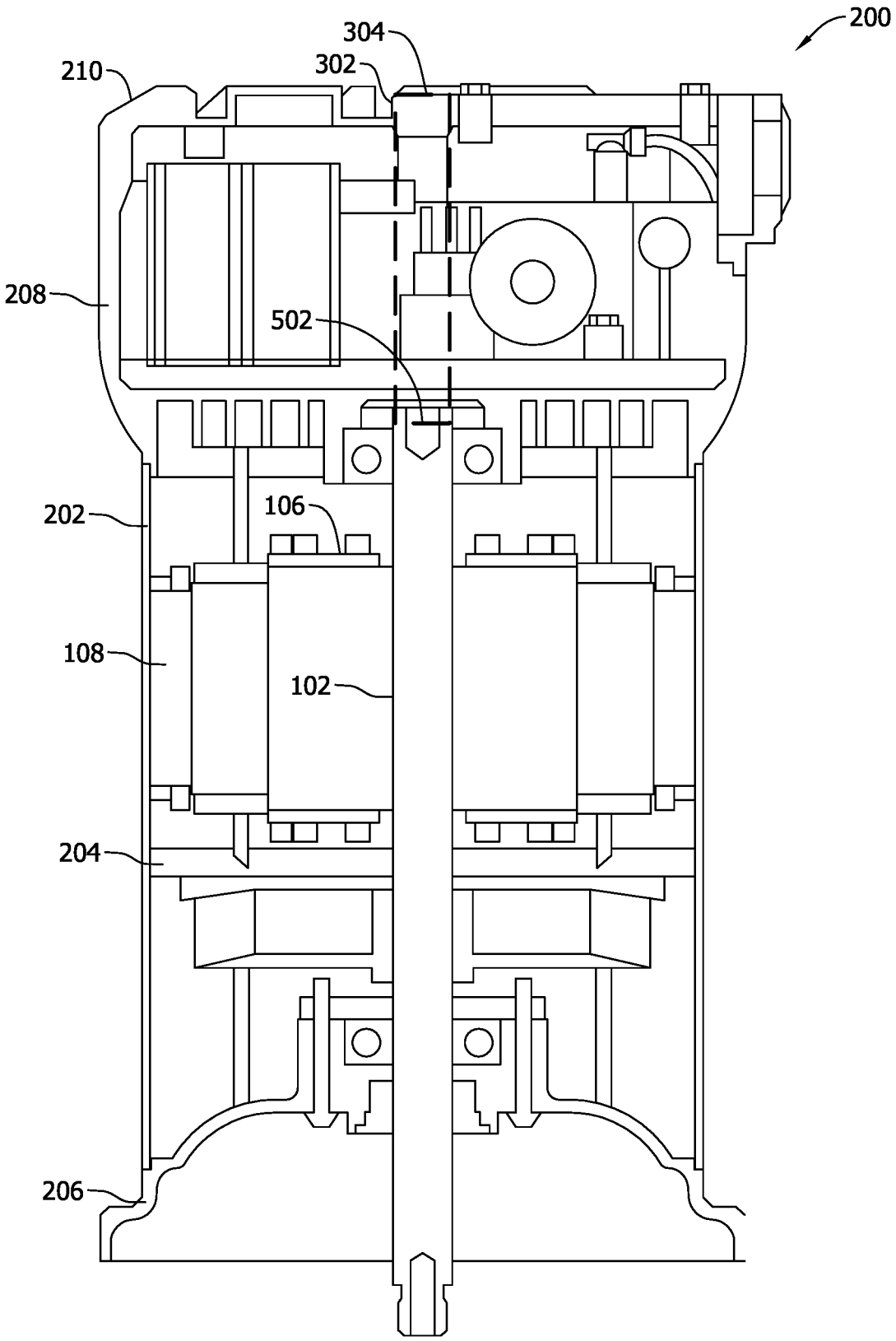
FIG. 5 is a cross-sectional view of the exemplary motor depicted in FIG. 2.

Referring to FIGS. 3, 4, and 5, motor 200 further includes a center hole 302 opening to a guide tube 304 that enables a user to insert a tool the extends through drive cover 210, motor controller 118, and drive end frame 208 to access, for example, a hex keyed shaft lock 502 that can be engaged to lock shaft 102. Because hex keyed shaft lock 502 is generally not visible to the user, drive cover 210 can include textual indications that provide, for example, instructions as well as the size of the required tool.

Motor 200 further includes a printed circuit board (PCB) 306, which may be used to implement at least part of motor controller 118. PCB 306 includes a line input 308, a neutral input 310, and a ground connector 312 configured to be connected to respective components of an AC line source to provide power to motor 200. In some embodiments, motor 200 further includes a screw 314 that holds PCB 306 in place and provides additional support for PCB 306 when lines are being coupled or decoupled from line input 308 and neutral input 310. In some embodiments, motor 200 further includes a single-connector wire 316 that remains permanently connected at one end to PCB 306, such that the user need only connect one point of a jumper to connect motor 200 to a 110 volt (V) or 220 V power source. This prevents the jumper from becoming lost and also allows the user to focus on properly installing only one connecting point of a jumper as opposed to two. In some embodiments, PCB 306, upon which the jumper is plugged, includes silkscreen label on both 110 V and 220 V sides to provide instruction to the user.

Figure 6:
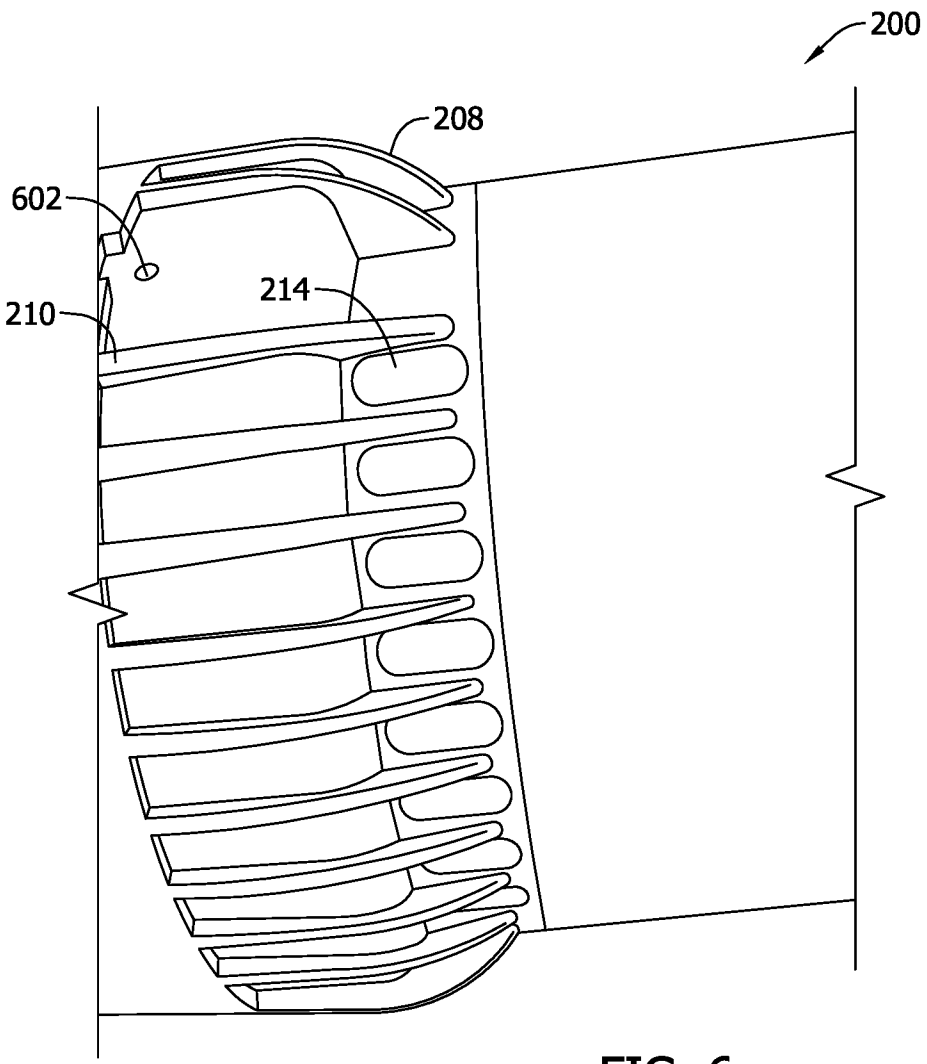
FIG. 6 is another perspective view of the exemplary motor depicted in FIG. 2.

Referring to FIG. 6, in some embodiments, motor 200 includes a weep hole 602 disposed within drive end frame 208. Weep hole 602 allows condensation to escape before impacting electronic components of motor controller 118 in a way that could cause failure. In some embodiments, weep hole 602 is downward facing with respect to an orientation of installation. In such embodiments, the surface in which weep hole 602 is present is not located at a maximum diameter of the drive end frame 208 to prevent weep hole 602 from being blocked by an installation surface.

Figure 7:
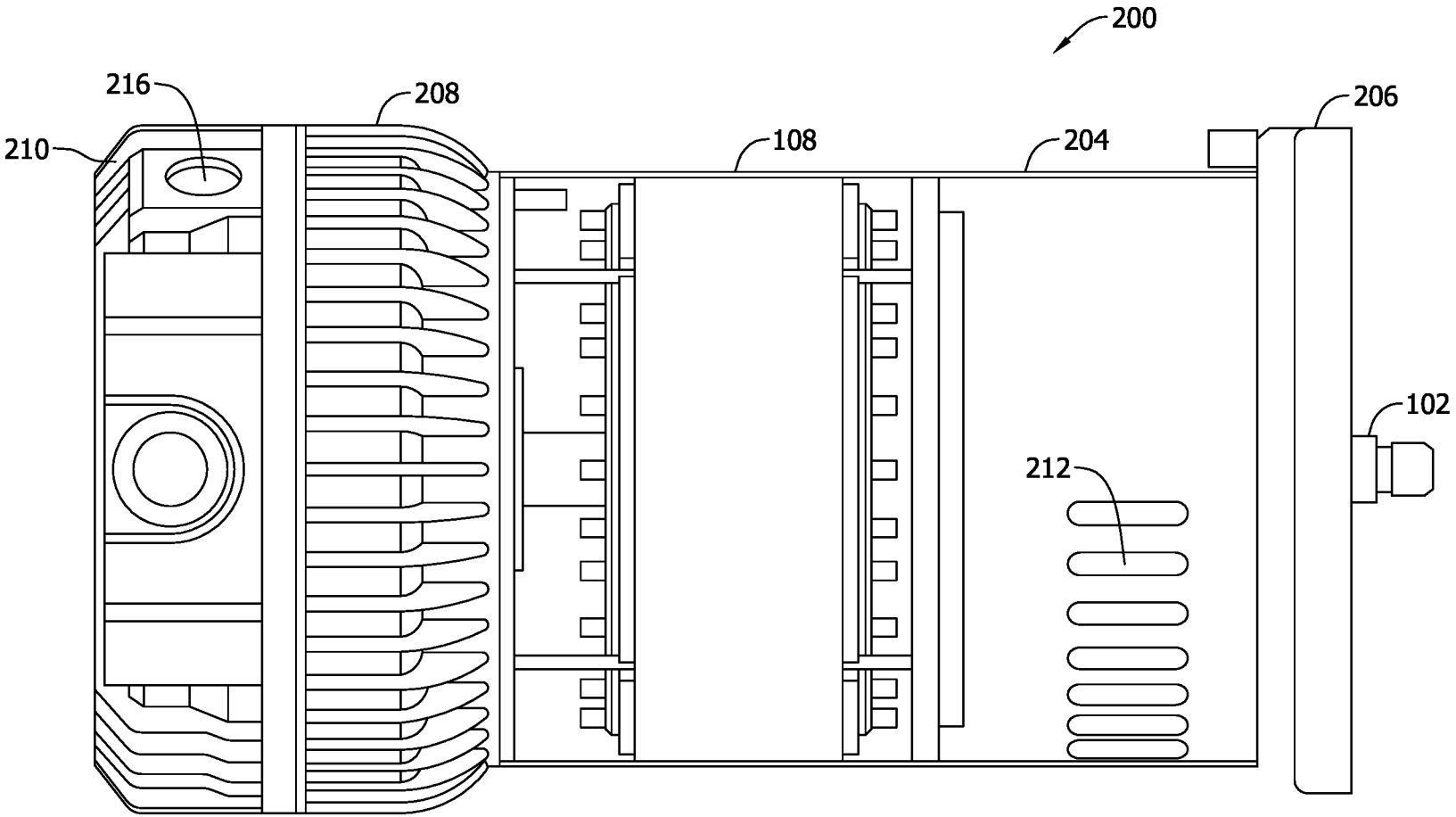
FIG. 7 is a partially transparent view of the exemplary motor depicted in FIG. 2.

Referring to FIG. 7, motor 200 includes a drive end bearing 702 embedded into the drive end frame 208. In other words, a single piece forms drive end frame 208, a heat sink, and drive end bearing 702. Drive end bearing 702 benefits from the cooling air generated by the motor fan at the shaft end, because the bearing is directly coupled to the heatsink.

Figure 8:
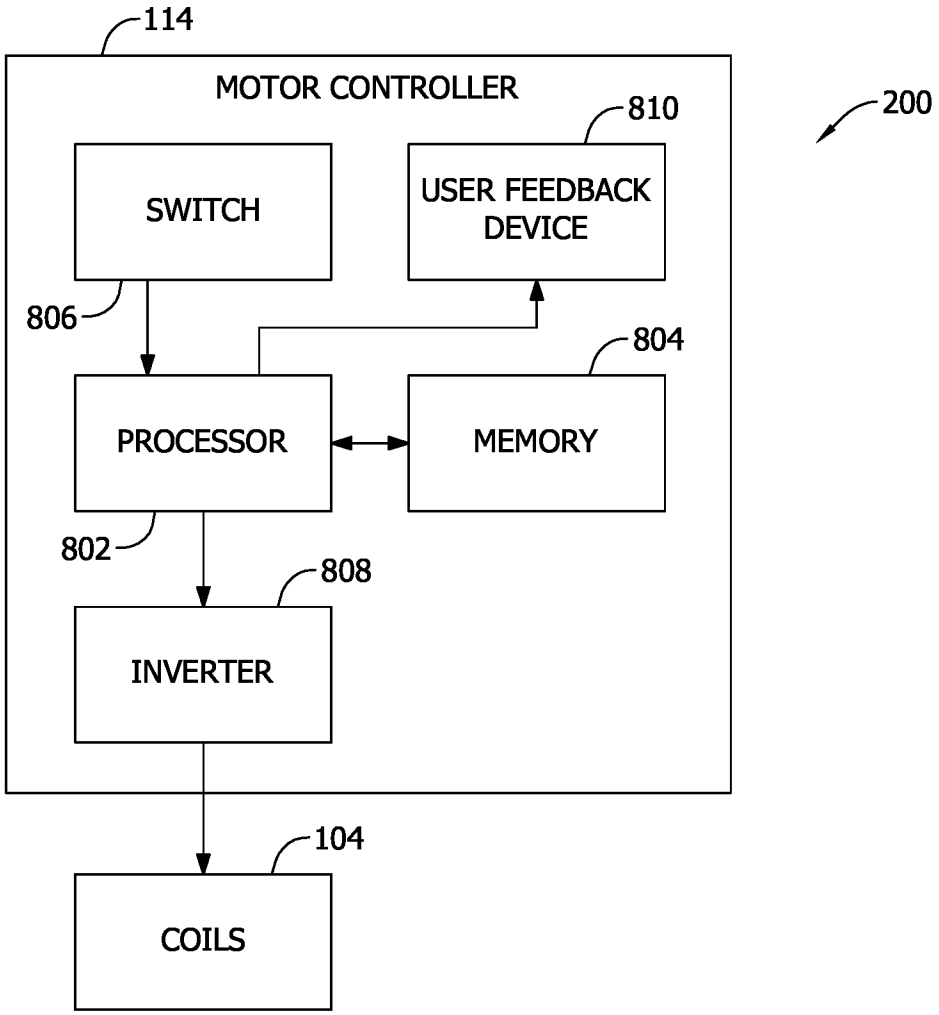
FIG. 8 is a block diagram of the exemplary motor depicted in FIG. 2.
Figure 10A:
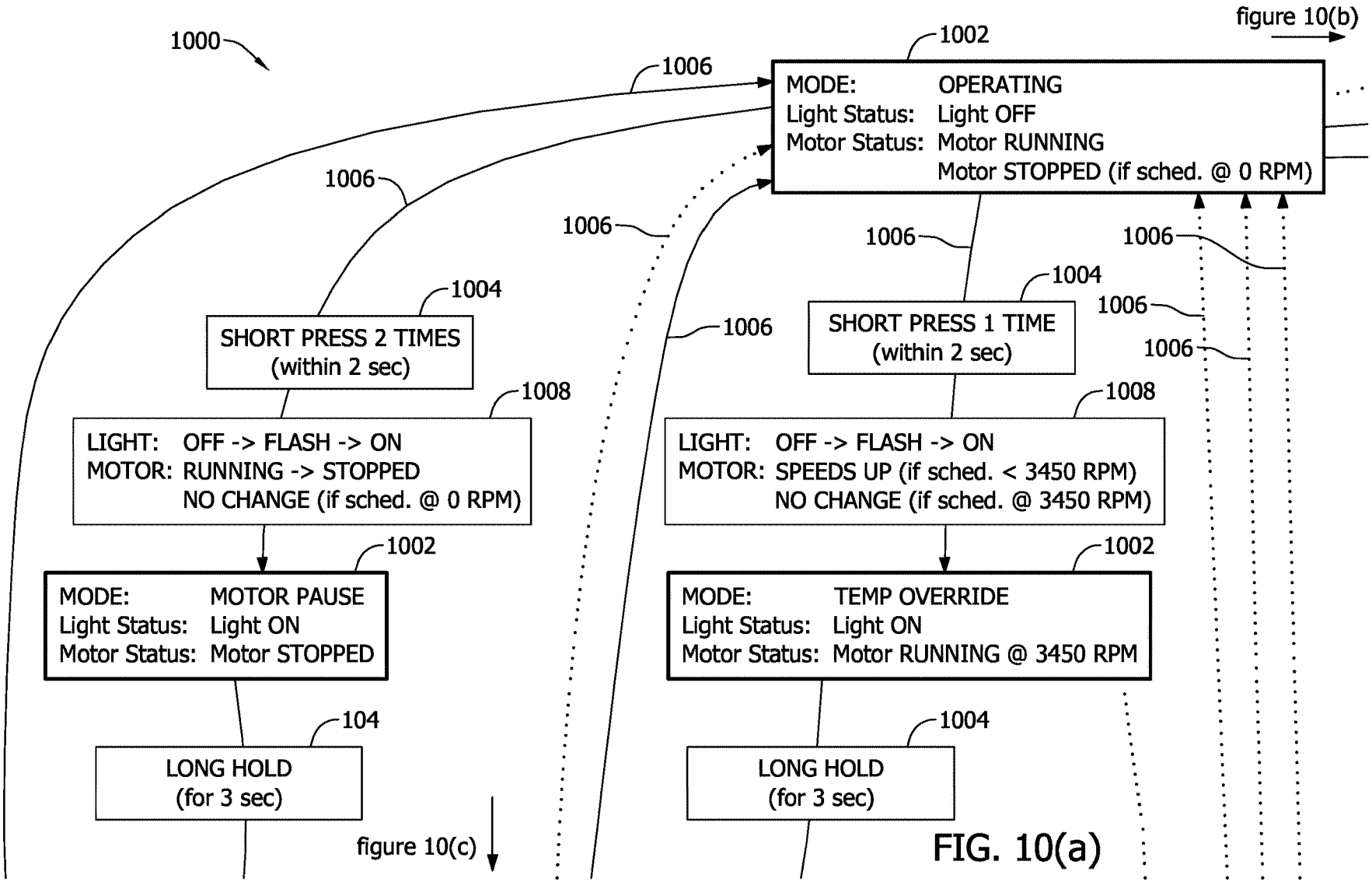
FIG. 10A is a logic map illustrating an exemplary process performed by the exemplary motor depicted in FIG. 2.
Figure 10B:
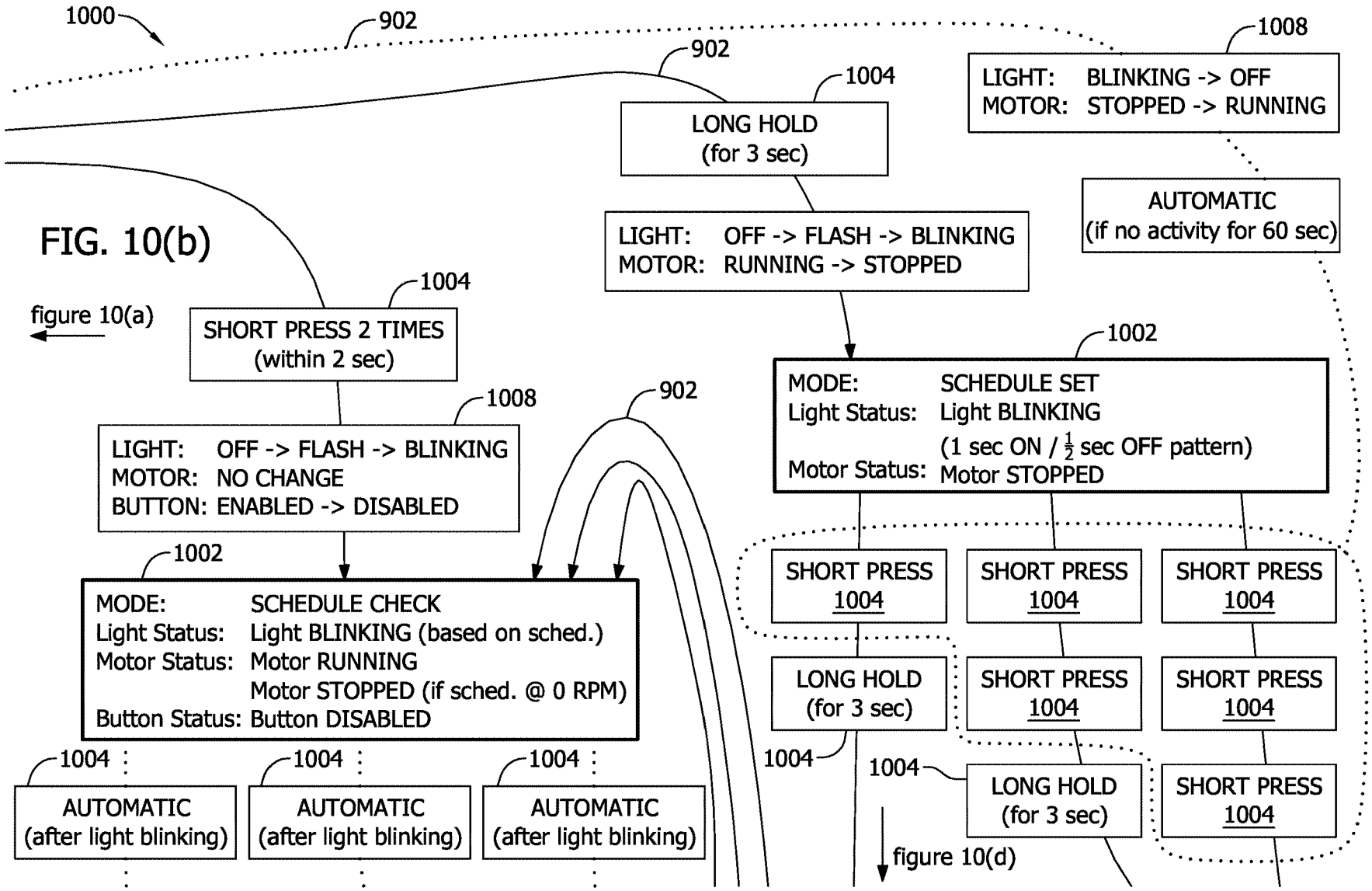
FIG. 10B is a continuation of the logic map shown in FIG. 10A.
Figure 10C:
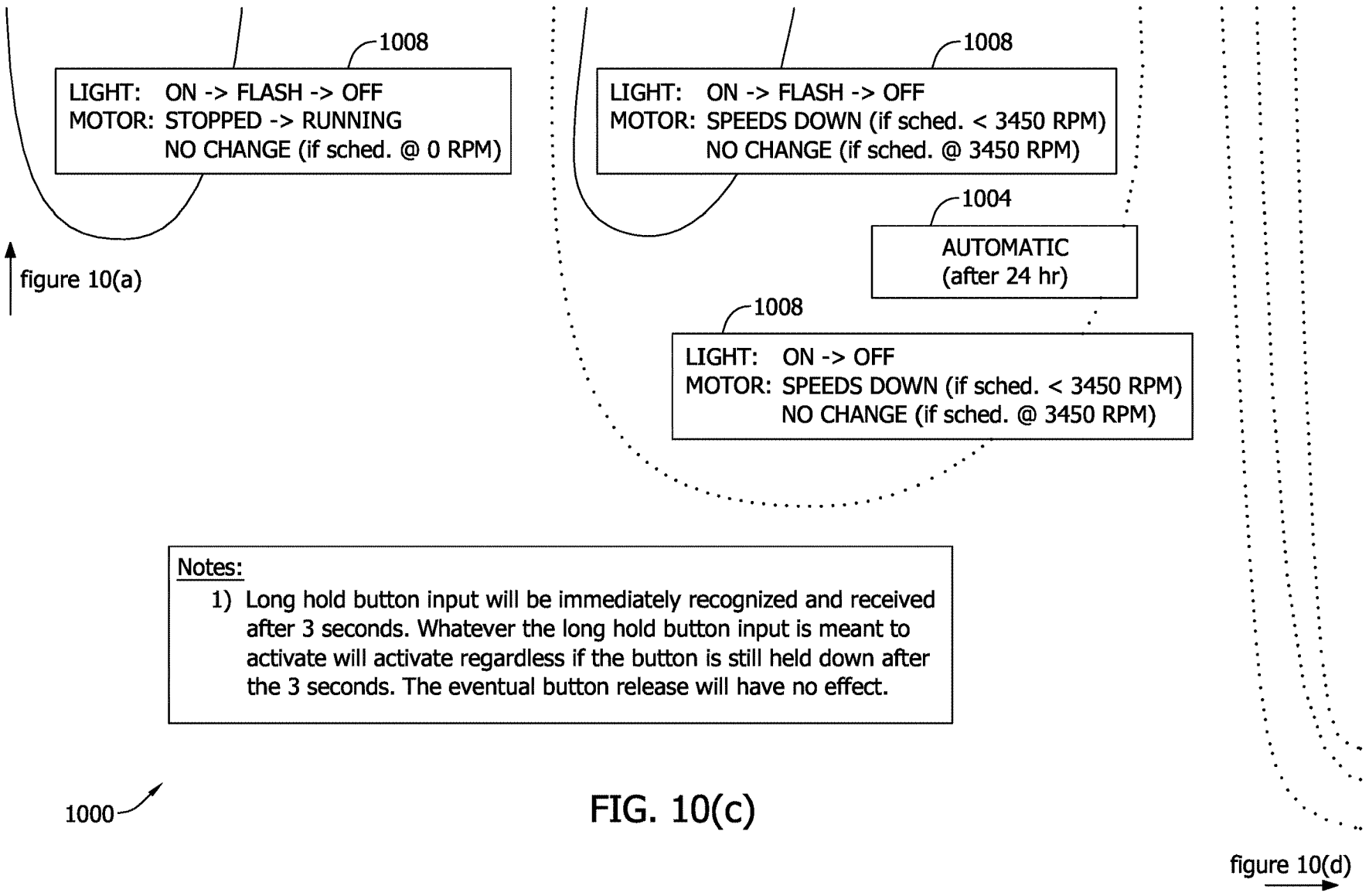
FIG. 10C is a continuation of the logic map shown in FIGS. 10A and 10B.
Figure 10D:
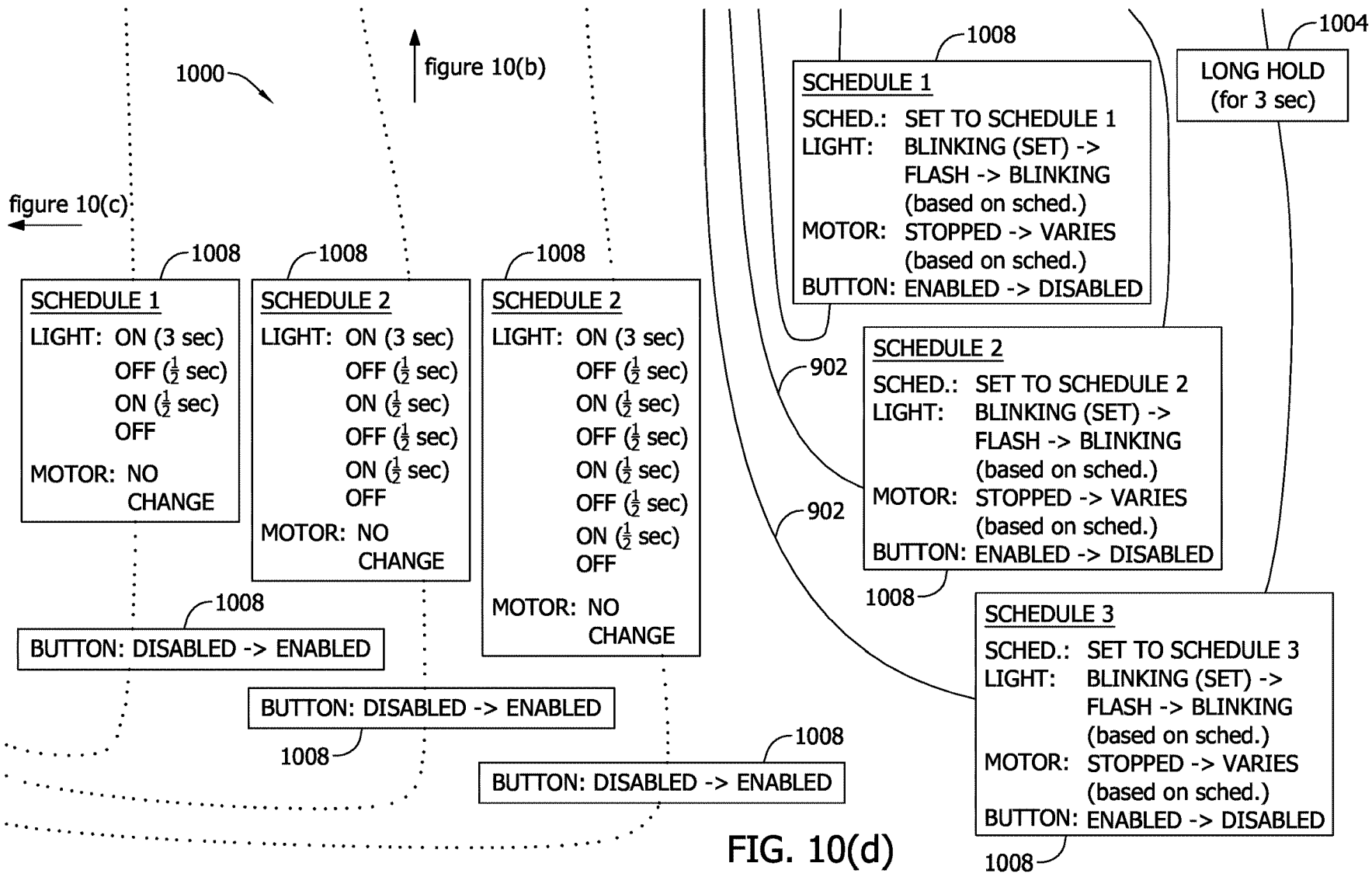
FIG. 10D is a continuation of the logic map shown in FIGS. 10A, 10B, and 10C.

FIG. 8 is a partial block diagram of motor 200. Motor controller 118 and coils 104 generally function as described with respect to FIGS. 1 and 2. Motor controller 118 includes a processor 802, a memory 804, a switch 806, and an inverter 808. In some embodiments, switch 806 is implemented as push button 216 (shown in FIG. 2). Processor 802 is configured to communicate with memory 804, switch 806, and inverter 808. Processor 802 provides control signals to inverter 808, and inverter 808, in response, supplies current to coils 104. Accordingly, processor 802 can control, for example, a speed at which motor 200 operates. In some embodiments, processor 802 is configured to communicate with a user device, for example, through a wired or wireless communication channel, such as a serial interface or a Wi-Fi or Bluetooth connection. In such embodiments, users may view status data and control motor 200 via, for example, a mobile or web application.

Memory 804 is configured to store a plurality of actuation sequences that a user may perform using switch 806. Memory 804 may further store a plurality of commands, each of which is associated with an actuation sequence. Each of the plurality of commands corresponds to a commanded mode of operation of motor 200 such as, for example, a speed, a schedule of speeds over a period (e.g. a day), temporarily run at a maximum speed, temporarily pause, or stop.

In some embodiments, switch 806 is configured to be actuated in a short press and a long press. The short press may be defined as less than two seconds, for example, about one second, and the long press may be defined as greater than two seconds, for example, about three seconds. Alternatively, in some embodiments, switch 806 includes variable pressure button that is configured to receive a low-pressure push and a high-pressure push. In further embodiments, other means for user input are used. For example, in some embodiment, a momentary push button can have a one-second duration interface, a 3-second duration interface, a 10-second duration interface, and a 30-second duration interface. Furthermore, the variations of switch 806 can be used both separately and together in sequence to indicate different commands to the motor product. Additionally, the variations can include not only the duration during which switch 806 is actuated by the user, but also the duration of time between multiple instances of actuation.

In some embodiments, the commands can include running one of a multitude of 24-hour time/speed schedules, override commands to run full speed, maintenance modes, start commands, stop commands, and pause commands. The 24-hour time/speed schedules are only one example of a type of schedule that can be commanded. Other examples include 8-hour and 12-hour schedules, continuously variable speed during a relatively long duration (such as increase from 1000 RPM to 2000 RPM over 4 hours), and schedules that are described based on parameters other than speed and time including pool size, ambient temperature, energy efficiency, and water temperature to name a few.

In some embodiments, motor 200 includes a user feedback indicator device 810 that can be, for example, an LED (e.g., LED 218), an audible speaker/buzzer, or a physical flag that changes position to indicate feedback. User feedback indicator device 810 is controlled by processor 802 and can indicate feedback in sequences of digital nature or in an analog nature. In an exemplary embodiment the user feedback indicator device is an LED that is integral to switch 806. In some such embodiments, processor 802 is configured to cause the LED flash in different timed sequences on and off sequentially with a timing that is an indication to the user of a specific mode. In alternative embodiments, the processor 802 is configured to cause the LED to be dimly or brightly lit in alternating sequence to provide feedback. Furthermore, the LED can be turned fully on or fully off without sequence to indicate yet other feedback to the user. In embodiments where user feedback indicator device 810 is a speaker or a buzzer, the indication can be a sequence of tones, different frequency of tones, different decibel (dB) level of sound, and in some cases can "speak" pre-programmed words indicating feedback.

FIG. 9 is a table 900 illustrating exemplary modes of operation of motor 200 that may be initiated by a user by actuating switch 806. Table 900 includes a switch actuation sequence column 902 that includes a plurality of example switch actuation sequences that may be input by a user with switch 806. As described above, each switch actuation sequence includes one or more short (e.g., 1 second) actuation instances (e.g., presses) or long (e.g., 3 second) actuation instances, represented respectively by dots and dashes. Table 900 further includes an executed command column 904 that includes a name of a schedule or command corresponding to each actuation sequence. For example, a sequence of one short press followed by one long press (i.e., one dot followed by one dash) indicates a command for motor 200 to operate according to "Schedule #1."

Table 900 further includes a priming period column 906 that indicates, for each schedule or command, whether a priming period will occur after the command is entered and the corresponding length of the priming period and speed at which motor 200 is operated during the period. For example, when a command to perform "Schedule #1" is given, there is no priming period and motor 200 is immediately operated according to "Schedule #1." When a command to perform "Schedule #3" is entered, motor 200 is operated at a speed of 3450 rotations per minute (RMP) for a period of three minutes before operation according to "Schedule #3" is commenced.

Table 900 further includes schedule description columns 908 that include a speed column 912 and a duration column 914 corresponding to each speed column 912. Each speed column 912 indicates a speed in RPM at which motor 200 is operated for the duration indicated in hours in the corresponding duration column 914. When the duration has expired, motor 200 is operated according to the next speed and duration to the right. The durations indicated for each command generally add up to 24 hours, and the schedule may be repeated once each 24 hour period expires. For example, when a command for "Schedule #1" is entered, motor 200 is first operated at a speed of 3450 RPM for a period of 2 hours, then operated at a speed of 1725 RPM for 8 hours, then at a speed of 1100 RPM for 2 hours, and then turned OFF for a period of 12 hours, at the expiration of which "Schedule #1" is repeated.

FIGS. 10A-10D are a logic map of an exemplary process 1000 for operating motor 200 according to user commands input, for example, using switch 606. In some embodiments, process 1000 is implemented using processor 802. Process 1000 includes a plurality of modes 1002. Each mode 1002 includes parameters under which motor 200 and other components such as user feedback indicator device 810 are operated while in a state of each mode 1002. For example, while in the "OPERATING" mode, motor 200 is running and user feedback indicator device 810 is OFF.

Process 1000 further includes a plurality of commands 1004. In some embodiments, commands 1004 correspond to commands defined in command column 904 of table 900. When a command 1004 is entered, for example, using switch 806 or automatically in response to a time period expiring, the state of motor 200 changes to a different mode 1002, as indicated by arrows 1006. Changes in the operation of motor 200 and user feedback indicator device 810 during transitions between modes 1002 are indicated by intermediate boxes 1008.

Figure 11:
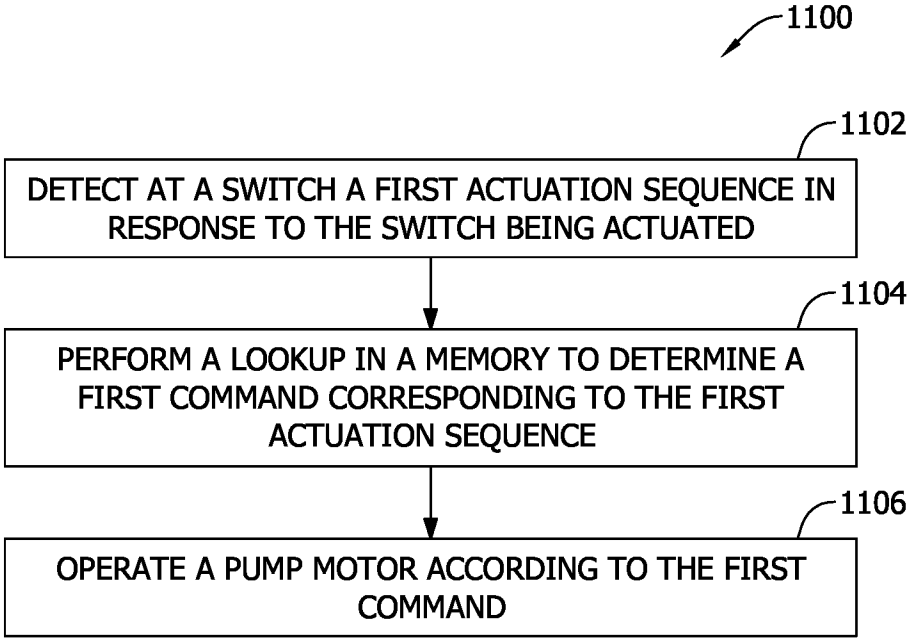
FIG. 11 is a flow diagram depicting an exemplary method for controlling the exemplary motor depicted in FIG. 2.

FIG. 11 is a flow diagram of an exemplary method 1100 of controlling motor 200. Method 1100 may be embodied in a motor controller, such as motor controller 118 shown in FIGS. 1 and 8.

Motor controller 118 detects 1102, at switch 806, a first actuation sequence in response to switch 806 being actuated. Motor controller 118 performs 1104 a lookup in memory 804 to determine a first command corresponding to the first actuation sequence. Motor controller 118 operates 1106 motor 200 according to the first command.

The methods and systems described herein may be implemented using computer programming or engineering techniques including computer software, firmware, hardware or any combination or subset thereof, wherein the technical effect may include at least one of: (a) providing a user interface for a pool or spa pump motor by a single button coupled to a processor that detects sequences of actuations at the button to determine operating commands; (b) increasing cooling efficiency of a pump motor by providing open drip proof vents on a housing of the motor; (c) providing a shaft lock for a pump motor having a rear-mounted motor controller by providing a guide tube extending through a housing of the motor controller to provide access to the shaft lock; (d) enabling a motor to switch between two inputs corresponding to different voltage levels by including a single-connector wire with two different input configurations; (e) improving space efficiency of a pump motor by mounting a motor controller of the pump motor on a rear end of the pump motor; (f) increasing ease of use of a user interface of a pump motor by including a push button on the top 40 percent of a surface of a pump motor; (g) increasing cooling efficiency within a pump motor by providing two sets of vents disposed on opposite ends of a housing of the pump motor to increase air flow through the housing; (h) providing moisture protection to circuitry of a motor controller by providing a weep hole in a housing of the motor controller; and (i) increasing space efficiency of a pump motor by integrating a drive end bearing, heat sink, and end plate of a housing of the pump motor into a single piece.

In the foregoing specification and the claims that follow, a number of terms are referenced that have the following meanings.

As used herein, an element or step recited in the singular and preceded with the word "a" or "an" should be understood as not excluding plural elements or steps, unless such exclusion is explicitly recited. Furthermore, references to "example implementation" or "one implementation" of the present disclosure are not intended to be interpreted as excluding the existence of additional implementations that also incorporate the recited features.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here, and throughout the specification and claims, range limitations may be combined or interchanged. Such ranges are identified and include all the sub-ranges contained therein unless context or language indicates otherwise.

Disjunctive language such as the phrase "at least one of X, Y, or Z," unless specifically stated otherwise, is generally understood within the context as used to state that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. Additionally, conjunctive language such as the phrase "at least one of X, Y, and Z," unless specifically stated otherwise, should also be understood to mean X, Y, Z, or any combination thereof, including "X, Y, and/or Z."

Some embodiments involve the use of one or more electronic processing or computing devices. As used herein, the terms "processor" and "computer" and related terms, e.g., "processing device," "computing device," and "controller" are not limited to just those integrated circuits referred to in the art as a computer, but broadly refers to a processor, a processing device, a controller, a general purpose central processing unit (CPU), a graphics processing unit (GPU), a microcontroller, a microcomputer, a programmable logic controller (PLC), a reduced instruction set computer (RISC) processor, a field programmable gate array (FPGA), a digital signal processing (DSP) device, an application specific integrated circuit (ASIC), and other programmable circuits or processing devices capable of executing the functions described herein, and these terms are used interchangeably herein. The above embodiments are examples only, and thus are not intended to limit in any way the definition or meaning of the terms processor, processing device, and related terms.

In the embodiments described herein, memory may include, but is not limited to, a non-transitory computer-readable medium, such as flash memory, a random access memory (RAM), read-only memory (ROM), erasable programmable read-only memory (EPROM), electrically erasable programmable read-only memory (EEPROM), and non-volatile RAM (NVRAM). As used herein, the term "non-transitory computer-readable media" is intended to be representative of any tangible, computer-readable media, including, without limitation, non-transitory computer storage devices, including, without limitation, volatile and non-volatile media, and removable and non-removable media such as a firmware, physical and virtual storage, CD-ROMs, DVDs, and any other digital source such as a network or the Internet, as well as yet to be developed digital means, with the sole exception being a transitory, propagating signal. Alternatively, a floppy disk, a compact disc-read only memory (CD-ROM), a magneto-optical disk (MOD), a digital versatile disc (DVD), or any other computer-based device implemented in any method or technology for short-term and long-term storage of information, such as, computer-readable instructions, data structures, program modules and sub-modules, or other data may also be used. Therefore, the methods described herein may be encoded as executable instructions, e.g., "software" and "firmware," embodied in a non-transitory computer-readable medium. Further, as used herein, the terms "software" and "firmware" are interchangeable, and include any computer program stored in memory for execution by personal computers, workstations, clients and servers. Such instructions, when executed by a processor, cause the processor to perform at least a portion of the methods described herein.

Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

The systems and methods described herein are not limited to the specific embodiments described herein, but rather, components of the systems and/or steps of the methods may be utilized independently and separately from other components and/or steps described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to provide details on the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A motor controller for a pump motor, said motor controller comprising:

an input device;

a memory configured to store a plurality of actuation sequences and a plurality of commands, wherein each actuation sequence is associated with a command;

a processor coupled to said input device, said memory, and the pump motor, said processor configured to:

detect at said input device, a first actuation sequence in response to said input device being actuated;

perform a lookup in said memory to determine a first command corresponding to the first actuation sequence; and operate the pump motor according to the first command.

2. The motor controller of claim 1, wherein said input device comprises a push button.

3. The motor controller of claim 1, wherein each command of the plurality of commands includes at least one speed and at least one duration corresponding to the at least one speed.

4. The motor controller of claim 1, wherein each actuation sequence includes one or more short actuation instances or long actuation instances.

5. The motor controller of claim 4, wherein each of the short actuation instances is less than two seconds and each of the long actuation instances is greater than two seconds.

6. The motor controller of claim 1, further comprising a user feedback indicator device configured to provide at least one of a visible indication or an audible indication to a user in response to instruction from said processor.

7. The motor controller of claim 6, wherein said user feedback indicator device comprises a light emitting diode (LED).

8. A method for controlling a pump motor, said method comprising:

detecting, by a motor controller at an input device, a first actuation sequence in response to the input device being actuated;

performing, by the motor controller, a lookup in a memory to determine a first command corresponding to the first actuation sequence, the memory configured to store a plurality of actuation sequences and a plurality of commands, wherein each actuation sequence is associated with a command; and operating, by the motor controller, the pump motor according to the first command.

9. The method of claim 8, wherein detecting the first actuation sequence comprises detecting actuation of a push button.

10. The method of claim 8, wherein determining the first command comprises determining at least one speed and at least one duration corresponding to the at least one speed.

11. The method of claim 8, wherein detecting the first actuation sequence comprises detecting one or more short actuation instances or long actuation instances.

12. The method of claim 11, wherein each of the short actuation instances is less than two seconds and each of the long actuation instances is greater than two seconds.

13. The method of claim 8, further comprising providing, by a user feedback indicator device of the motor controller, at least one of a visible indication or an audible indication to a user.

14. The method of claim 13, wherein the user feedback indicator device includes a light emitting diode (LED).

15. A pump motor comprising:

an inverter configured to supply current to stator coils;

a motor controller comprising:

an input device;

a memory configured to store a plurality of actuation sequences and a plurality of commands, wherein each actuation sequence is associated with a command;

a processor coupled to said input device, said memory, and said inverter, said processor configured to:

detect at said input device, a first actuation sequence in response to said input device being actuated;

perform a lookup in said memory to determine a first command corresponding to the first actuation sequence; and operate said inverter according to the first command.

16. The pump motor of claim 15, wherein said input device comprises a push button.

17. The pump motor of claim 15, wherein each command of the plurality of commands includes at least one speed and at least one duration corresponding to the at least one speed.

18. The pump motor of claim 15, wherein each actuation sequence includes one or more short actuation instances or long actuation instances.

19. The pump motor of claim 18, wherein each of the short actuation instances is less than two seconds and each of the long actuation instances is greater than two seconds.

20. The pump motor of claim 15, further comprising a user feedback indicator device configured to provide at least one of a visible indication or an audible indication to a user in response to instruction from said processor.

* * * * *